US005143396A

United States Patent [19]

Shaanan et al.

[11] Patent Number: 5,143,396

[45] Date of Patent: Sep. 1, 1992

[54] BINDING FOR A SNOWBOARD AND A SNOWBOARD INCORPORATING THE BINDINGS

[76] Inventors: Gad Shaanan; Serge Provost; Jerome Foy, all of c/o 19151 Cruickshank, Baie D'Urfe, Quebec, Canada, H9X 3N9

[21] Appl. No.: 736,279

[22] Filed: Jul. 25, 1991

[30] Foreign Application Priority Data

Nov. 21, 1990 [CA] Canada ..... 2030429

[51] Int. Cl.[5] ..... A63C 9/14

[52] U.S. Cl. ..... 280/607; 280/633; 280/14.2; 441/70

[58] Field of Search ..... 280/611, 607, 617, 618, 280/623, 633, 635, 636, 14.2; 441/70

[56] References Cited

U.S. PATENT DOCUMENTS

| | | | |
|---|---|---|---|
| 3,424,469 | 1/1989 | Hooker | 280/608 |
| 4,973,073 | 11/1990 | Raines et al. | 780/633 |
| 4,995,631 | 2/1991 | Hunter | 280/14.2 |
| 5,028,068 | 7/1991 | Donovan | 280/14.2 |
| 5,035,443 | 7/1991 | Kincheloe | 280/14.2 |
| 5,090,722 | 2/1992 | Ritchie et al. | 280/14.2 |

FOREIGN PATENT DOCUMENTS

| | | | |
|---|---|---|---|
| 819597 | 8/1969 | Canada . | |
| 954547 | 9/1974 | Canada . | |
| 989435 | 5/1976 | Canada . | |
| 2627993 | 9/1989 | France | 280/14.2 |

*Primary Examiner*—Andres Kashinikow
*Assistant Examiner*—Richard Camby
*Attorney, Agent, or Firm*—McFadden, Fincham, Marcus & Anissimoff

[57] ABSTRACT

A binding for a snowboard has a base, side members extending upwardly and rearwardly from the sides of the base, towards the back of the base, with an arcuate member joining the rear ends of the side members. Fastening means on one side member and on one side edge of the board at the front provide for attachment of one end of each of two straps. Fastening means on the other side member and on the other side edge serve for attachment of a locking bar which in turn connects the other end of each strap to the side member and base. Attachment means are provided in the base for attachment to a snowboard. A snowboard for use in conjunction with the binding has a forward attachment position which provides for attachment of a binding inclined in either direction as desired, that is forward and to the right or forward and to the left, as desired, at about 45°. A rear attachment position provides for attachment of the binding transverse of the board. The snowboard, of elongate form, has a rounded front end and both front and rear ends curve upwardly. In plan profile the snowboard is waisted and in side profile is also arched or curved. A rim extends around the periphery of the board and at the rear, in transverse cross-section, the bottom surface has a spherical surface extending downwards from the plane of the bottom surface. The board may, or may not, have steel edges.

20 Claims, 10 Drawing Sheets

BINDING FOR A SNOWBOARD AND A SNOWBOARD INCORPORATING THE BINDINGS

FIELD OF THE INVENTION

This invention relates to a binding for a snowboard.

Snowboarding is a popular sport on snow slopes. Snowboarding is practiced using a single board, referred to as a snowboard, which is a relatively short wide board. The user has both feet on the board, held in position by bindings.

BACKGROUND OF THE INVENTION

The present invention is concerned with a binding for holding and retaining the boot of a user on the board. Two bindings are required, one for each foot.

The sport of snowboarding has recently become very popular among snow and waterskiers as well as other sports enthusiasts.

Snowboarding has catapulted to popularity since it combines much of the enjoyment from other leisure activities such as windsurfing, skate boarding, skiing, etc. in one maintenance-free and inexpensive item. In addition, snowboarding allows a greater degree of freedom for the user since the single board is much more easily manipulated than two skis. The boards and bindings are designed to allow a user to ride the board sideways. In order to allow a user the greatest degree of freedom while using the board, a durable and supportive binding is required as is positioning thereon.

In the prior art a variety of monoskis are disclosed. One such example is Canadian patent No. 819,597. The document indicates a monoski which does not differ much in length or width from a conventional ski. The feet of the user are placed one in front of the other. There is no provision made for retaining the feet of a user bound to the ski. There is a frictional textured surface on the surface of the ski to prevent slipping thereon. The ski further includes guide vanes on the snow contacting surface of the ski. The ski of the invention is not adapted for use as in the present invention i.e. free-style skiing since the ski does not include any binding which highly limits its use.

A further Canadian patent No. 954,547 discloses a single ski. In this device the feet of a user are situated juxtapositionally and bound to the ski by any known binding means. The ski is indicated to be somewhat shorter than a conventional ski. A similar problem exists with this invention as in the above-mentioned. Since the feet are placed in such a manner, the manipulation and control of the ski are limited in comparison to foot positioning which is spaced apart and angled as in the present development.

Another Canadian patent No. 989,435 indicates another side-by-side arrangement with a heel and toe binding means. This arrangement is inappropriate for freedom of movement.

SUMMARY OF THE INVENTION

The invention provides a snowboard and bindings to be used therewith. The bindings include a base having side and ends with the sides of sufficient extension to prevent lateral movement of the foot of a user while therein. The binding further includes a heel portion extending partially up the leg of the user. In aggregation, these components appear and function as a ski boot shell and binding the user's feet within the boot a releasably locking bar is operatively associated with one of the sides of the binding. The locking bar further includes strap members which are placed across the feet and fasten to the opposed side of the binding to fastening means thereon. The board, onto which the binding is fastened, includes means for fastening the front binding sideways and forward to the right or sideways and forward to the left.

The binding of the present invention provides for quick simple attachment of a users boot to the snowboard, and which is quickly and easily releasable.

Broadly, a binding in accordance with the invention comprises a base having sides and front and rear ends, an enclosing member extending upwardly and rearwardly and having side members each extending up and rearwardly from a side of the base, the side members being joined at the rear by an arcuate member extending substantially normal to the plane of the base. Each side member has fastening means, a first fastening means on one side member for attachment of one end of the first strap and second fastening means on the other side member for connection of the other end of the first strap; further fastening means on each side of the base adjacent to the front end of the base and comprising a first fastening means on the one side for attachment of one end of a second strap and a second fastening means on the other side for connection of the other end of the second strap, both said first fastening means on the same side; and a locking member for engagement with both of said second fastening means, said locking member comprising an elongate bar having a first attachment means at a rear end for attachment of the other end of said first strap and second attachment means at a front end for attachment of the other end of said second strap, said bar also having a first engaging means at a front end for engagement with said second fastening means on said other side of said base, and a second engaging means at a rear end for engagement with said second fastening means on said other side member; said locking bar, with said straps attached, engaging first with said second fastening means on said base and then engaging, and locking with said second fastening means on said other side member to hold a users boot in the binding.

In accordance with a feature of the invention, fastening means are provided in the base of the binding for fastening the binding to a snowboard. In a particular embodiment, in the combination of bindings and a snowboard (hereafterwards referred to as a board) the board has fastening positions such that a front binding can be inclined sideways and forwardly at two alternative orientations, sideways and forward to the right or sideways and forward to the left. The board also has fastening positions such that a rear binding can be attached extending laterally of the board, the rear binding facing in the same general direction as the front binding, that is to the right or to the left.

The invention will be readily understood by the following description of an embodiment of the invention, by way of example, in conjunction with the accompanying drawings.

DETAILED DESCRIPTION OF THE PREFERRED EMBODIMENTS

Figure 1:
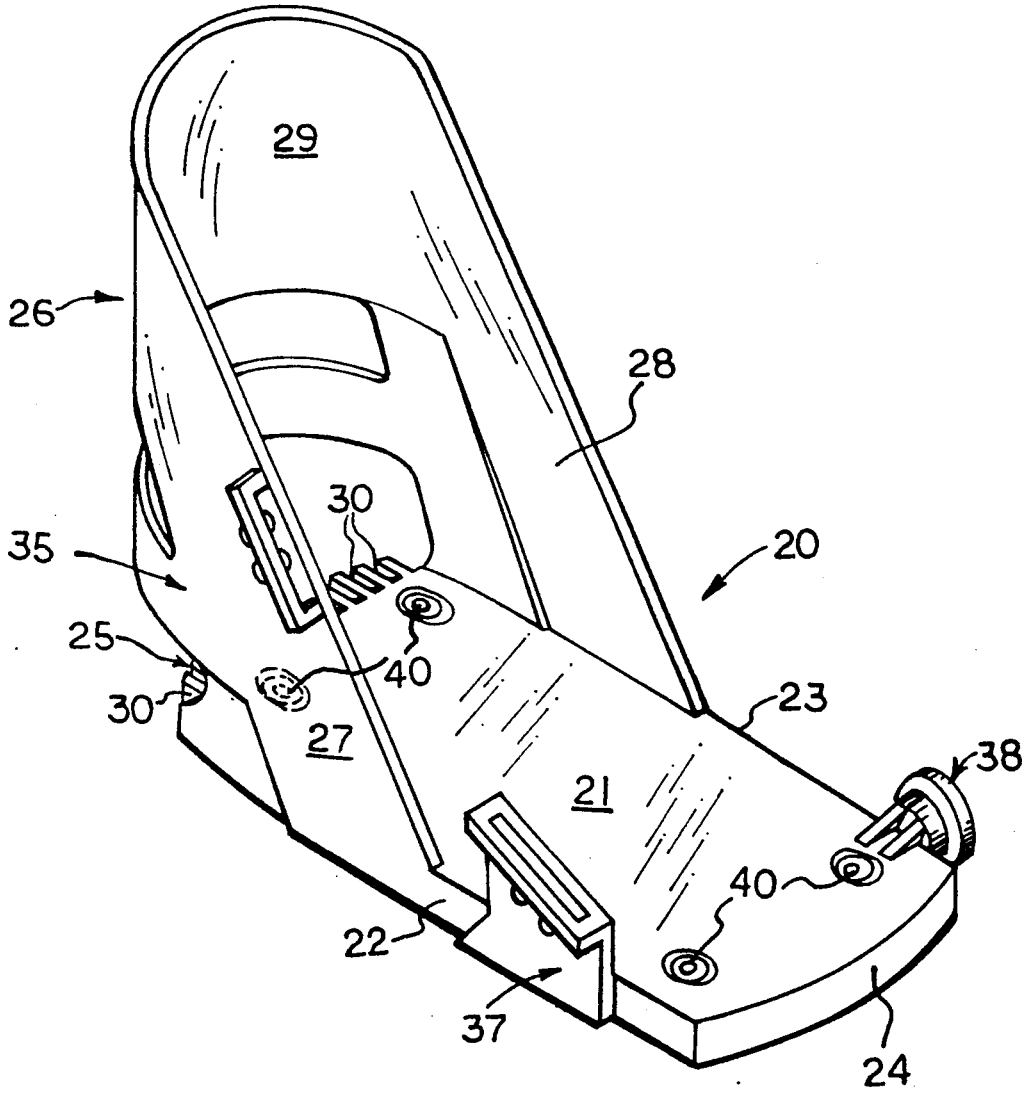
FIG. 1 is a perspective view of a binding, in accordance with the present invention.

As illustrated in FIG. 1, a binding 20 for a board comprises a base 21, which is elongate with substantially straight, parallel sides 22 and 23, a front end 24 and a rear end 25. Extending upwardly and rearwardly is an enclosing member 26, having side members 27 and 28 and an arcuate rear member 29 joining the rear edges of the side members. The side members extend upwardly and rearwardly and extend along the base from the rear ends in the example shown, for approximately half the length of the base. From the sides the side members have a somewhat triangular form. The front end 24 is slightly curved, as is also the rear end 25. A series of parallel slots 30 can be formed at the rear end extending for a major part of the thickness of the base from the top surface.

Figure 2:
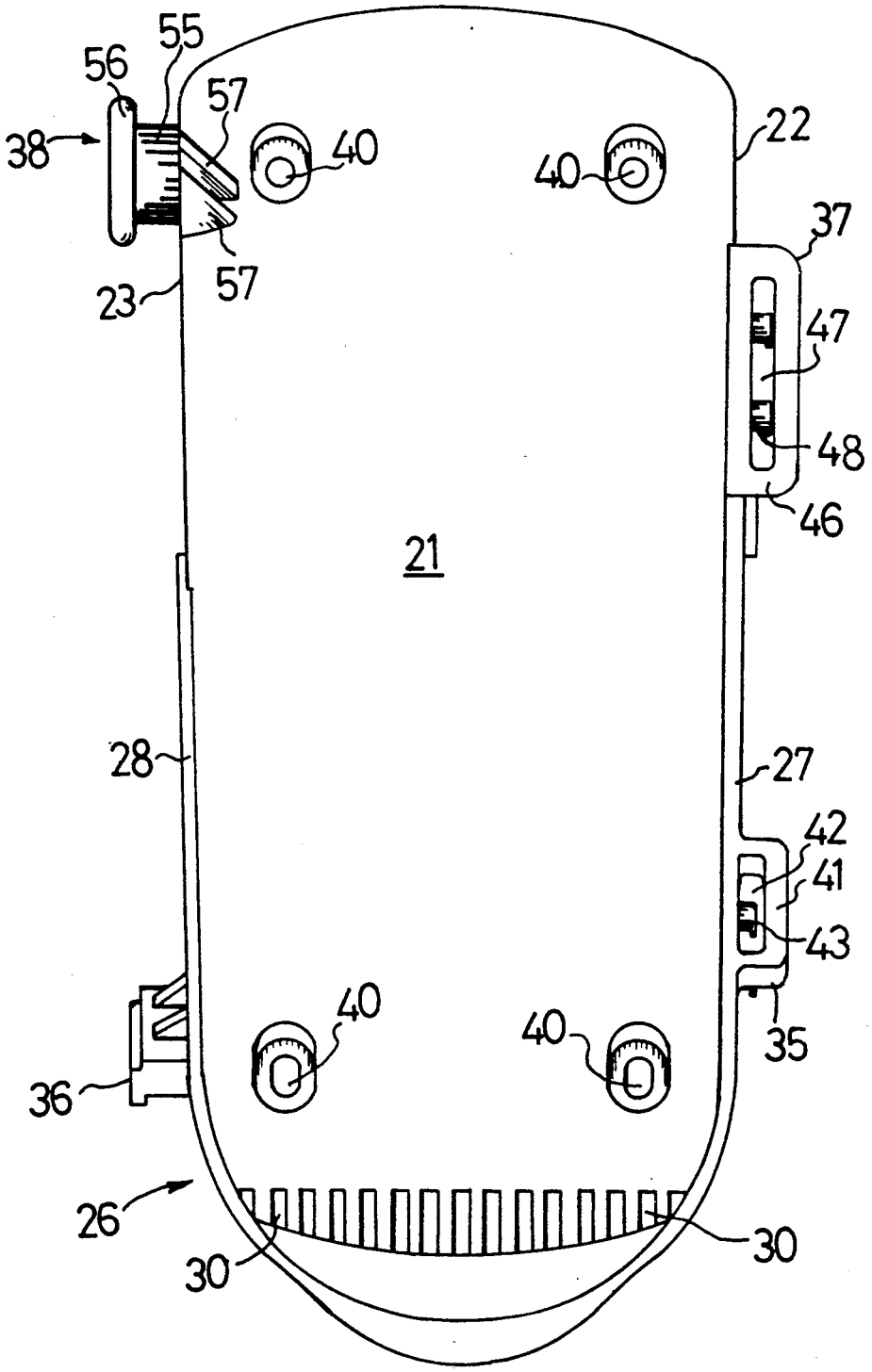
FIG. 2 is a top plan view of the binding.
Figure 3:
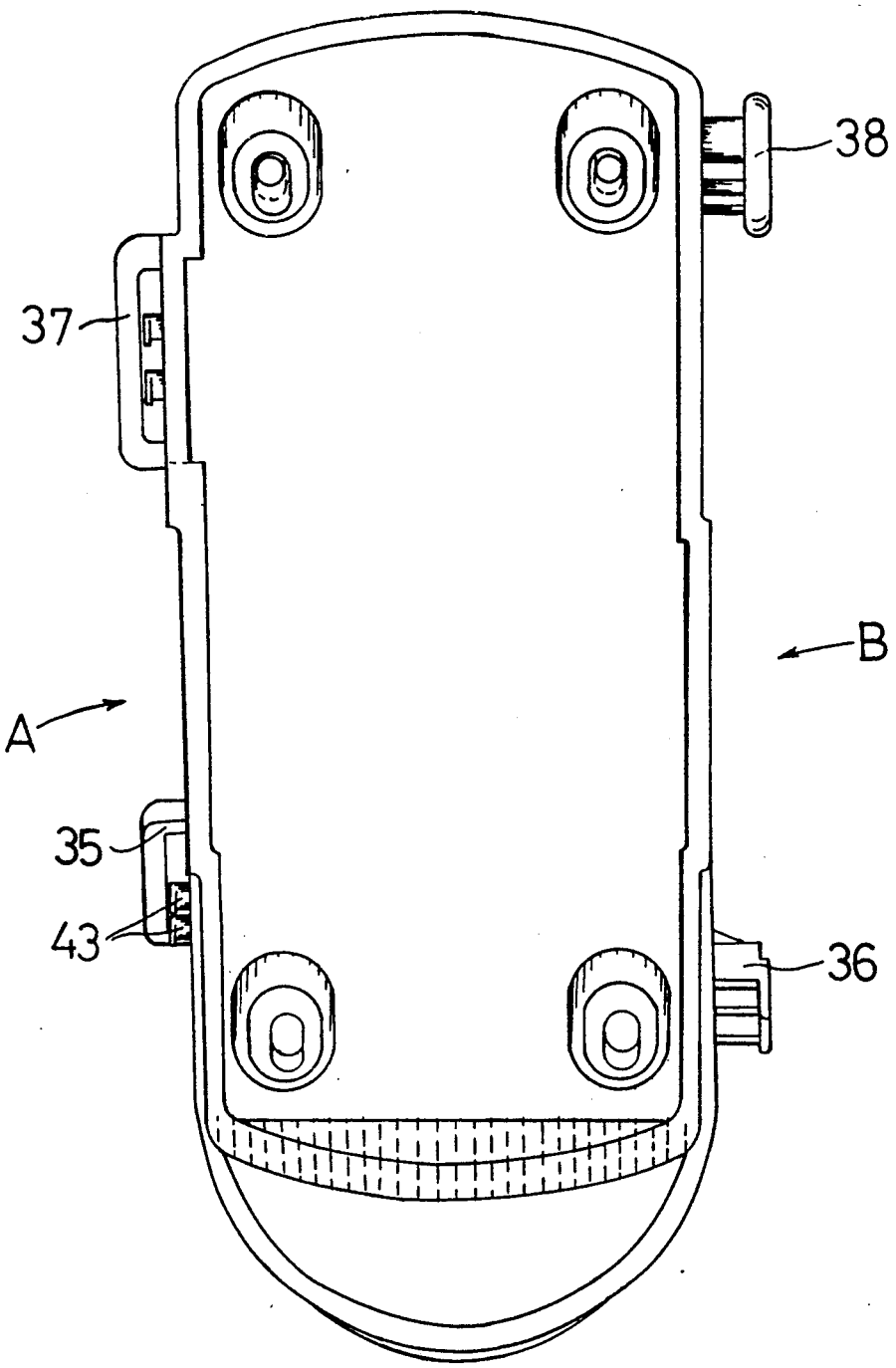
FIG. 3 is a bottom plan view of the binding.
Figure 4:
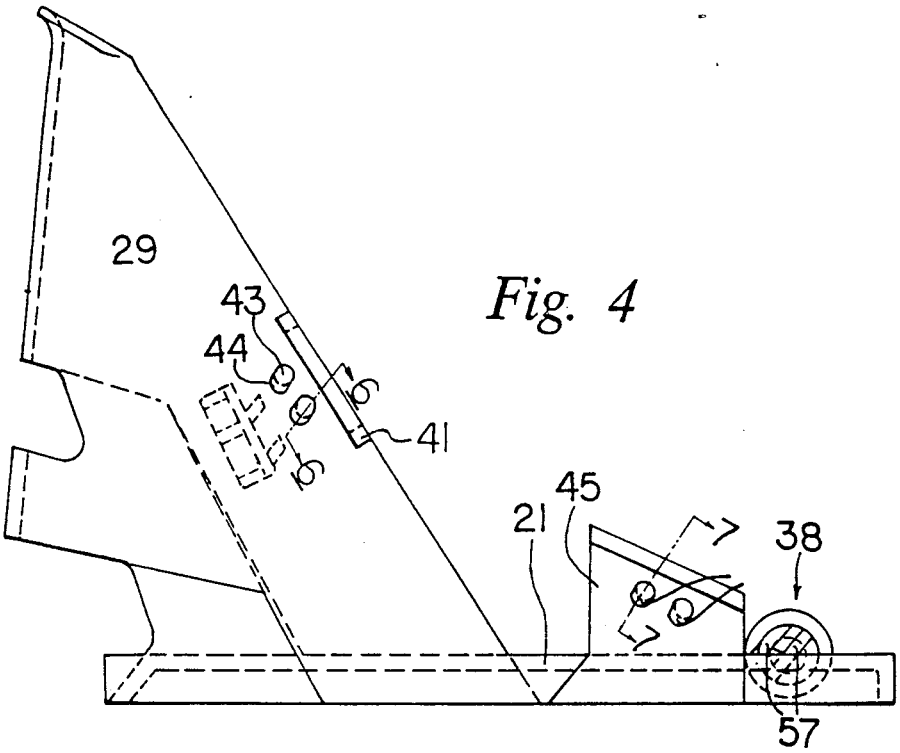
FIG. 4 is a side view in the direction of arrow A in FIG. 2.
Figure 5:
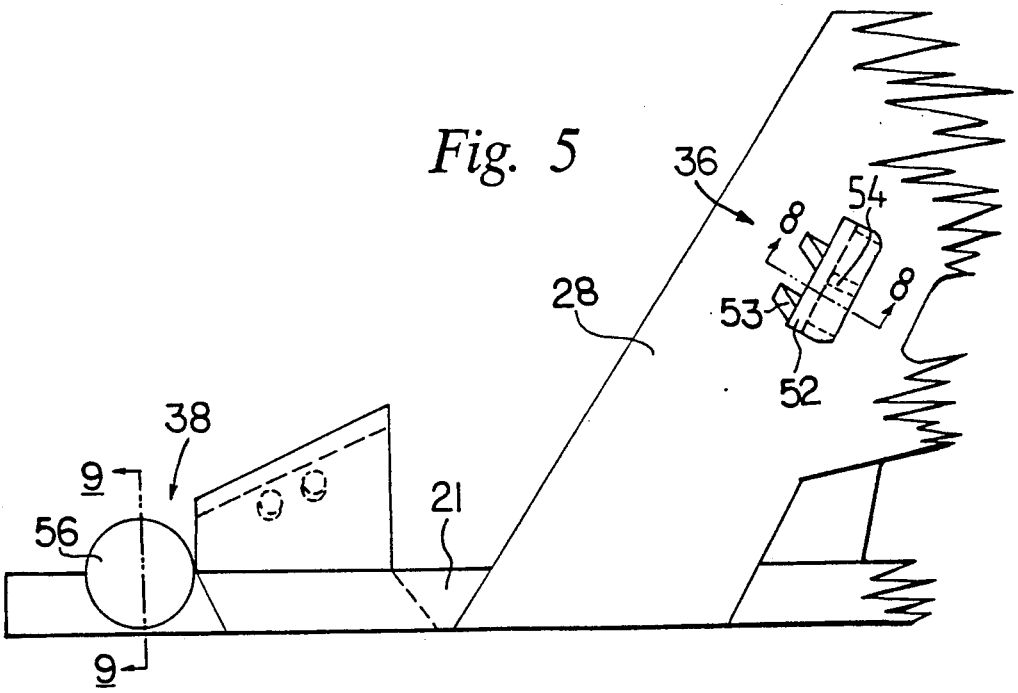
FIG. 5 is a partial side view in the direction of arrow B in FIG. 2.

Side member 27 has a first fastening means 35 fastening one end of a strap. A second fastening means is provided on the side member 28, not seen in FIG. 1 but shown at 36 in FIG. 2. Further first fastening means 37 and second fastening means 38 are provided on the sides 22 and 23 respectively of the base 21. First fastening means 37 is for fastening one end of a further strap. Second fastening means 36 and 38 are provided for the connection of the other ends of the straps by means of a locking bar, as will be described later. Holes 40 for screws or the like provide for attachment of the binding to a board.

Figure 6:
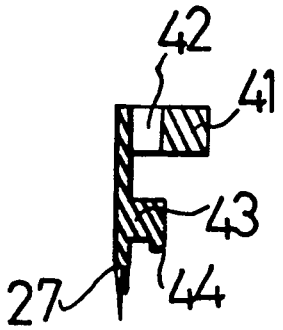
FIG. 6 is a cross-section on the line 6—6 of FIG. 4.

The arrangement, and the positioning, of the fastening means 35, 36, 37, and 38 is shown in the FIGS. 2 to 5. The two first fastening means 35 and 37 are adapted to hold or fasten one end of each of two straps. Fastening means 35 comprises a flange 41 extending laterally from the side member 27 with a slot 42 extending therethrough. Spaced from, but adjacent to the flange are two cylindrical pins or projections 43, each having an enlarged head 44 which extends beyond the main body of the pin. This is also seen in FIG. 6. A strap end is fed down through the slot 42 and holes in the strap pressed over the pins 43. A number of spaced pairs or holes can be provided at the strap end to provide for length adjustment.

Figure 7:
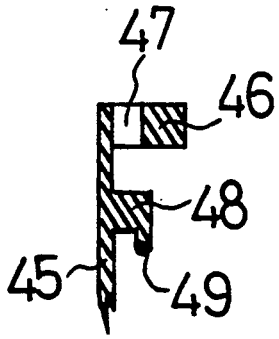
FIG. 7 is a cross-section on the line 7—7 of FIG. 4.

Fastening means 37 comprises a web 45 extending out from the side 22 of the base 21. At the top of the web 45 is an outwardly extending flange 46 having a slot 47 therethrough. Positioned below the flange 46 but adjacent thereto are two pins 48 having enlarged heads 49, as seen in FIG. 7. An end of the strap is fed down through the slot, holes in the belt being pushed over the pins. A number of spaced pairs of holes can be provided at the belt end to provide for length adjustment. It will be noted that the enlarged heads 49 of pins 48, and the enlarged heads 44 of pins 43 extend in a downward direction to retain the straps on the pins.

Figure 8:
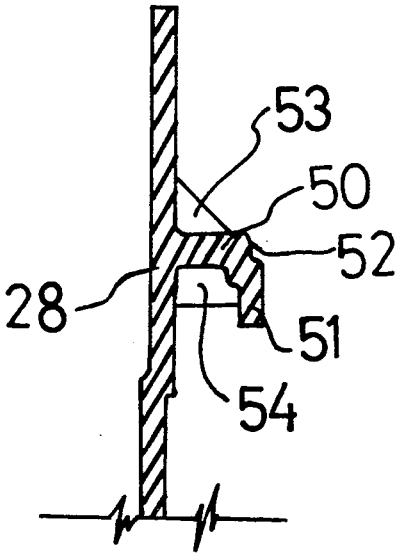
FIG. 8 is a cross-section on the line 8—8 of FIG. 5.
Figure 9:
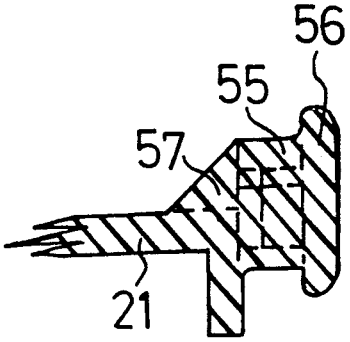
FIG. 9 is a cross-section on the line 9—9 of FIG. 5.

Fastening means 36 extends from the side member 28, and is spaced down from the forward edge of the side member. The fastening means comprise a short web 50 extending outward, molded to the side member 28 and inclined parallel to the edge of the side member. A short flange 51 extends downwardly and rearwardly from the outer end of the web 50. A channel or recess 52 is formed in the top forward edge of the web 50. This is seen more clearly in FIG. 8. Strengthening webs 53 and 54 are provided either side of the web 50.

Fastening means 38 comprises a cylindrical boss 55 extending from the side 23 of the base, with an enlarged cylindrical cap 56 at its outer end. The boss extends above the top surface of the base as it must not project below the bottom of the base. Strengthening ribs 57 extend from the base to the boss 55. The fastening means 36 and 38 cooperate with a locking bar to connect the other ends of the straps to the binding.

Figure 10:
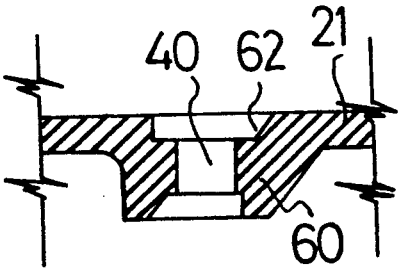
FIG. 10 is a cross-section on the line 10—10 of FIG. 2.
Figure 11:
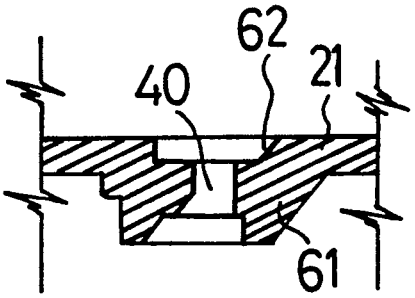
FIG. 11 is a cross-section on the line 11—11 of FIG. 2.

FIGS. 10 and 11 are cross-sections through the holes 40 for attaching the binding to a board. What can be termed as the rear holes 40 are shown in FIG. 10. A boss 60 is formed on the bottom surface of the base—which is recessed. The bottom surface of the boss rests on the board with screws passing through the holes 40 into nuts or similar members in the board. The front holes 40 are similar, with bosses 61 formed on the bottom surface of the base. Recesses 62 provide for the heads of the screws to be below the top surface of the base.

Figure 12:
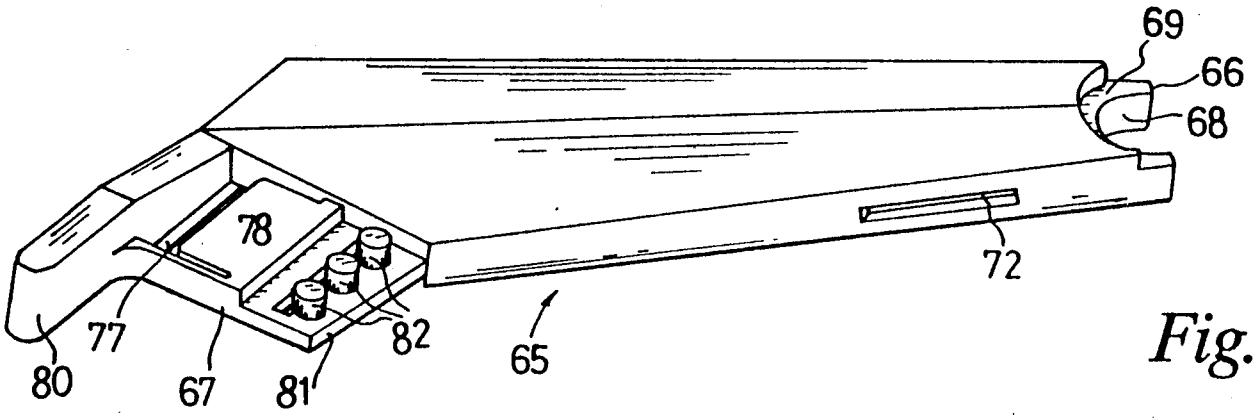
FIG. 12 is a perspective view of a locking bar.

FIGS. 12 to 17 illustrate a locking bar 65 for the binding illustrated in FIGS. 1 to 11. In FIG. 12, the locking bar is viewed looking at the outside surface. The locking bar, hereinafter referred to as the bar, is of elongate form, tapering rearwardly slightly from a front end 66 to a rear end 67. The front end has a semi-cylindrical slot 68, with an arcuate recess 69 extending for part of the slot 68. The slot 68 and recess 69 are dimensioned to fit on the cylindrical boss 55 and the cap 56 of the fastening means 38 on the binding. The boss fits in the slot 68 and the cap fits in the recess 69. The cap prevents the bar from moving sideways, away from the board, when the front end 66 is engaged with the fastening means 38.

At the rear end of the bar there is a formation 70 for engaging with the fastening means 36 and also a plurality of pins 71 for attachment or connection of the other end of the strap fastened to fastening means 35. Adjacent to the front end of the bar a slot 72 is provided for the other end of the strap fastened to fastening means 37, the slot not seen in FIG. 12, but shown in FIGS. 13 and 15.

Figure 13:
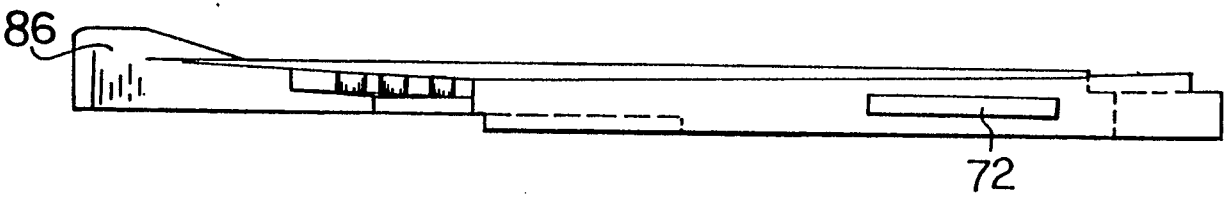
FIG. 13 is a top plan view of the locking bar.

FIG. 13, looking on the bottom edge 79 of the bar, shows the slot 72. Considering FIG. 15, looking at the inside surface of the bar, the bar is of a hollow form with a peripheral edge or wall 73 and ribs 74. At the front end, immediately to the rear of the slot 68 and recess 69, is a recess 75. The portion 76 is of full thickness of the bar and slot 72 is formed through this portion to communicate with the recess 75. In use, the related strap has an end portion of increased thickness. The other end of the belt is fed through the slot, from the recess 75, and pulled through until the thickened end enters the recess and is positioned in the recess, prevented from passing through the slot 72 by its thickness.

Figure 14:
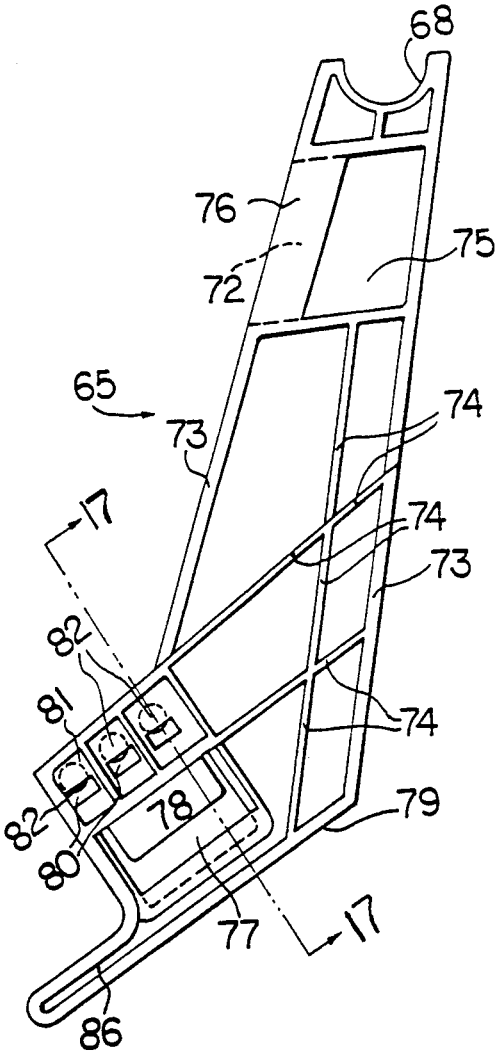
FIG. 14 is a side view in the direction of arrow C in FIG. 13.
Figure 15:
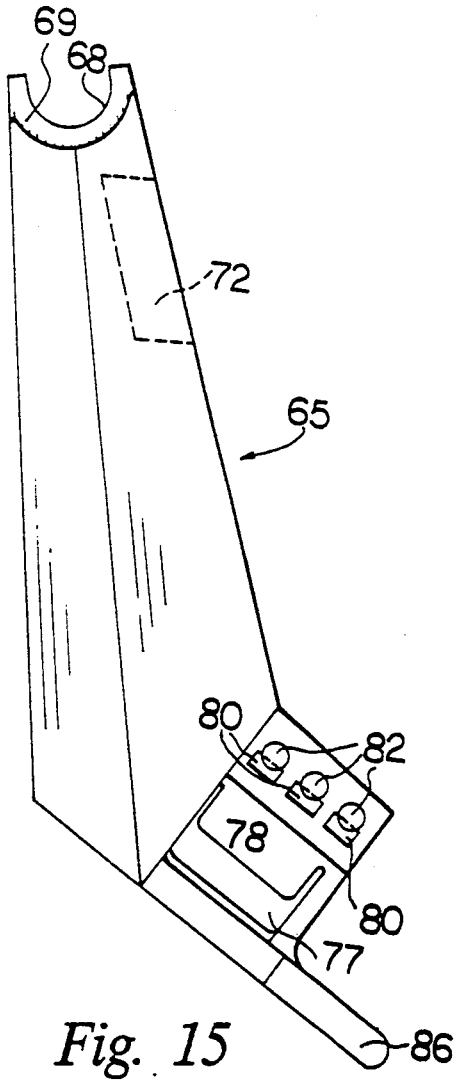
FIG. 15 is a side view in the direction of arrow D in FIG. 13.
Figure 17:
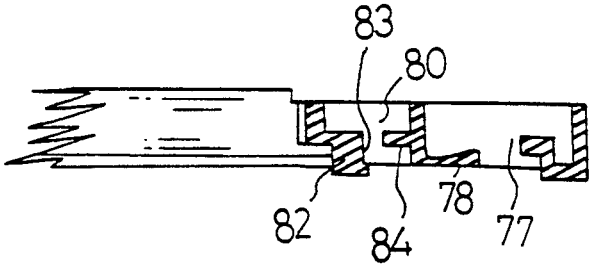
FIG. 17 is a cross-section on line 17—17 of FIG. 15.

At the rear end 67, an opening 77 is formed through the bar, with a thin flexible web 78 extending into the opening from one edge. The web extends in a direction towards the bottom edge 79. A plurality of small holes 80 are formed in the bar spaced from the opening 77. This portion, 81, of the bar is of reduced thickness and the plurality of pins 82 are formed on the outer side of surface, at pin 82 aligned with each hole 80. The cross-section in FIG. 17 shows these various items. As seen in FIG. 17, pins 82 are recessed at 83. In use the end of a strap is attached by inserting the pins through the holes in the end of the strap. The strap fits in the recesses 83, to prevent disengagement. The extreme end of the strap fits in the recess 84. The arrangement of the hole 77, web 78, holes 80 and pins 82 is also seen in FIG. 14.

Figure 16:
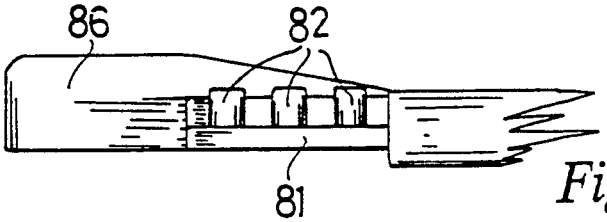
FIG. 16 is a partial view in the direction of arrow E in FIG. 14.

The opening 77 and web 78 cooperate with the fastening means 36 on the binding. The bar is locked on to the fastening means 36 by pushing on to the web 50 and flange 51, so that flange 51 enters the opening 77 and by flexing the web 78, the flange 51 passes through and latches over a protruding or rib 85 at the lower edge of the opening 77. The bar is held on the fastening means 36 by the interengagement between the web 50 and flange 51 and the opening 77 and the rib 85. A short extension or handle 86 extends at the rear end 67 and pushing down on the handle 86 releases the bar from the fastening means 36 (how this occurs is to be described). This is seen in FIG. 16.

Figure 18:
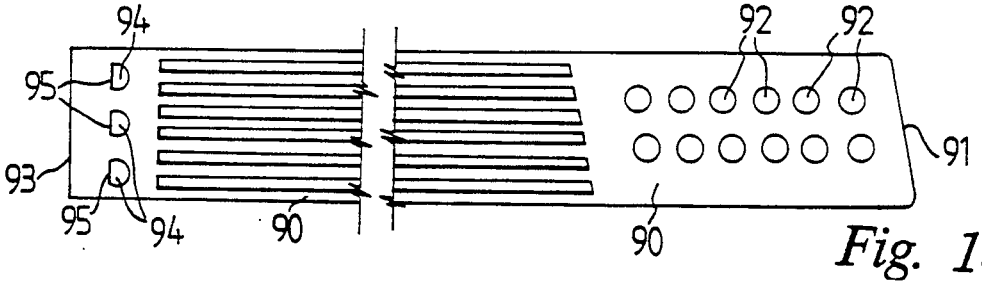
FIG. 18 is a plan view of a strap for use with the fastening means on the enclosing member, at an ankle position.
Figure 19:
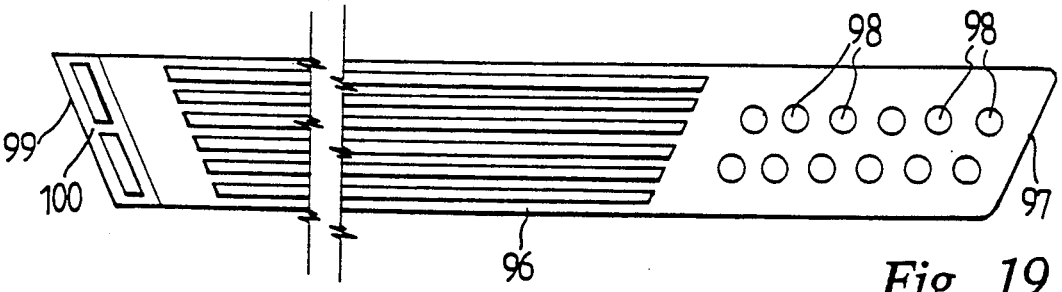
FIG. 19 is a plan view of a strap for use with the fastening means on the base, for the foot position.

FIGS. 18 and 19 illustrate two straps for use with the binding and bar. The strap 90 is used between the fastening means 35 and the connection means at the rear end of the bar, at the ankle position of the user. The one end 91 of strap 90 has a plurality of pairs of holes 92, which engage, as selected, with the pins 43 of the fastening means 35. The strap is fed through the slot 42 of the fastening means 35 and then fastened by inserting the pins 43 through one of the pairs of holes 92. The other end 93 of strap 90 has holes 94 which engage over the pins 82 on the bar. The flattened portions 95 of the holes 94 about the recessed portion 83 of the pins. Strap 96 is used between fastening means 37 and the connection means at the front end of the bar. One end 97 of the strap has the plurality of pairs of holes 98 which engage, as selected, with the pins 48 of fastening means 37, the strap passing through slot 42. The other end 99 has an enlarged thickness portion 100. As described in relation to the bar 65, the portion 100 fits into the recess 75 of the connection means at the front end of the bar. The outer surfaces of the straps can be ribbed, as shown in FIGS. 18 and 19.

Figure 20:
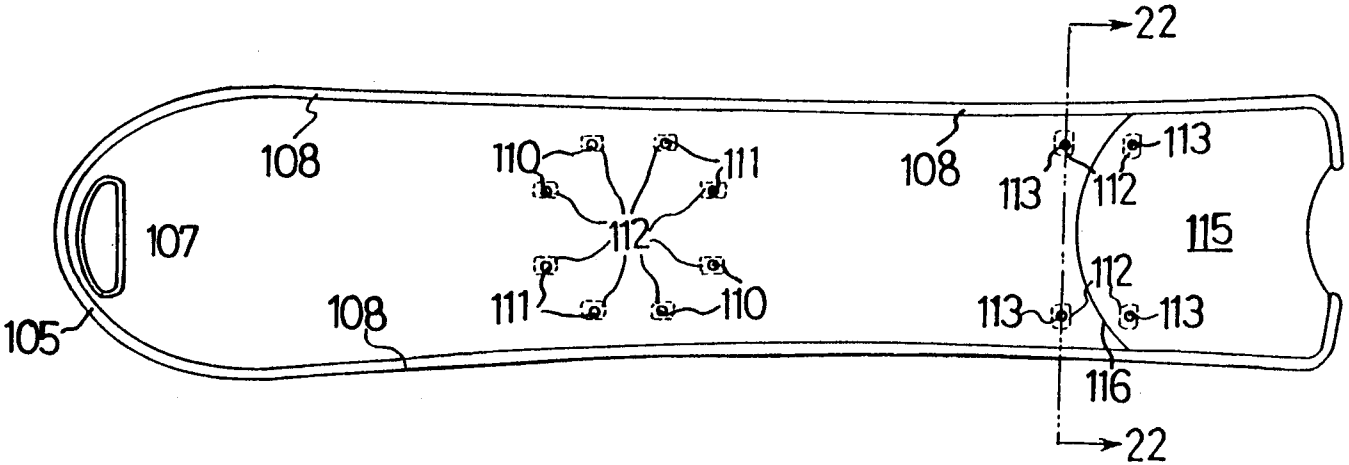
FIG. 20 is a top plan view of a board for use with the binding.
Figure 21:
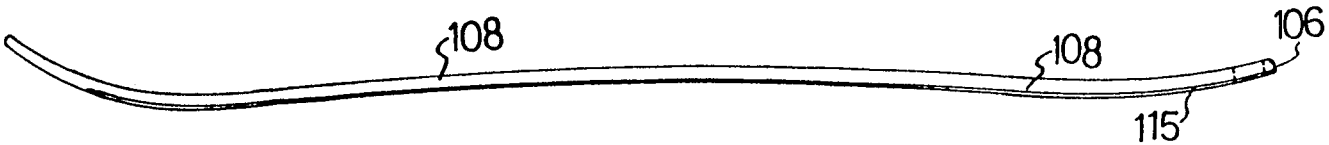
FIG. 21 is a side view of the board in FIG. 20.
Figure 22:
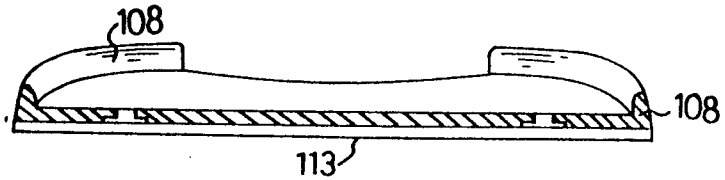
FIG. 22 is a cross-section on the line 22—22 of FIG. 20.

FIGS. 20, 21 and 22 illustrate one form of board to which the binder as illustrated in FIGS. 1 to 19 can be used. In the example illustrated, the board is elongate with an arcuate front end 105, which also curves forwardly and upwardly. The rear end 106 also curves upwardly. In plan form as in FIG. 20, the board has a waisted profile, both sides of the board having a slight inward curve from each end to the center. The minimum width, in the example, is slightly rearward of center. A cut-out 107 provides a hand-hold. An upstanding rim 108 extends for the periphery of the board, except for a short section at the rear end in the example illustrated. The board is also arched or curved when viewed from the side, as seen in FIG. 21.

At approximately the center of the board, or, as in the example, slightly forward of center is an attachment positioned for a binding. A binding extends diagonally across the board, at an angle of about 45°. There are provided two sets of four holes in the board, one set of holes 110 and another set of holes 111. Depending upon which set of holes are used to attach the binding, so the binding will be inclined forward and to the left or forward and to the right. A recess 112 in the bottom surface of the board, at each hole 110 and 111, provides for the head of a fastening device to be below the surface.

A further binding attachment position is provided towards the rear end 106. At this position four holes 113 are provided, the binding extending transversely of the board. Recesses 112 are formed also for holes 113.

A steel edge can be fitted along each side of the board.

At the rear end of the board, the bottom surface has a spherical profile, in transverse cross-section, as illustrated in FIG. 22, and also seen in FIG. 21. The spherical surface is indicated at 115. The spherical surface blends into the main bottom surface, along the line 116 in FIG. 20.

We claim:

1. A binding for a snowboard, comprising;

a base having opposite sides and front and rear ends;

an enclosing member having opposed spaced apart side members and an arcuate rear member, said rear member joining said side members at a rear position, the side members extending upwardly and rearwardly from said sides of said base at rear position on the base;

a first pair of fastening means comprising a first fastening means on one side member on one side of the base, and a second fastening means on the other side member, on the other side of said base;

a second pair of fastening means comprising a first fastening means on said one side of the base adjacent to the front end and a second fastening means on the other side of the base, adjacent to the front end;

a single removable locking member extending from said second fastening means of said first pair of fastening means to said second fastening means of said second pair of fastening means for engagement with each of said second fastening means of each said first and second pairs, said single removable locking member including a first attachment means for attaching one end of a first strap, and also including second attachment means for attaching one end of a second strap;

said first fastening means on each said first and second pairs of fastening means comprising means for attachment of the other end of each said first and second straps;

attachment means for attaching the binding to a snowboard.

2. A binding as claimed in claim 1, said arcuate rear member extending substantially vertical.

3. A binding for a snowboard, comprising;

a base having opposite sides and front and rear ends;

an enclosing member having opposed spaced apart side members and an arcuate rear member, said rear member joining said side members at a rear position, the side members extending upwardly and rearwardly form said sides of said base at rear position on the base;

a first pair of fastening means comprising a first fastening means on one side member on one side of the base, and a second fastening means on the other side member, on the other side of said base;

a second pair of fastening means comprising a first fastening means on said one side of the base adjacent to the front end and a second fastening means on the other side of the base, adjacent to the front end;

a locking member for engagement with each of said second fastening means of each said first and second pairs said locking member including a first attachment means for attaching one end of a first strap, and also including second attachment means for attaching one end of a second strap;

said first fastening means on each said first and second pairs of fastening means comprising means for attachment of the other end of each said first and second straps;

attachment means for attaching the binding to a snowboard, said binding including a gap between the bottom of said arcuate member and the base, said arcuate member extending out beyond said rear end of said base.

4. A binder as claimed in claim 1, said first fastening means of said first pair of fastening means comprising a flange extending laterally outward from said one side member and a slot extending through said flange, and a plurality of projections extending from said side member below and adjacent to said flange.

5. A binder as claimed in claim 1, said first fastening means of said second pair of fastening means comprising a web extending upwardly from said one side of said base, a flange extending laterally outward from an outer end of said web, a slot extending through said web, and a plurality of projections extending from said web below and adjacent to said side to said flange.

6. A binder as claimed in claim 5, said flange is inclined downwardly and forwardly.

7. A binder as claimed in claim 1, said second fastening means of said first pair of fastening means comprising a web extending outwardly from said other side member and a flange extending rearwardly from an outer end of said web.

8. A binder as claimed in claim 7, said web inclined upward and rearwardly parallel to a front edge of said other side member, and including a recess extending along said outer end of said web, said flange extending from said recess.

9. A binding as claimed in claim 1, said second fastening means of said second pair of fastening means comprising a cylindrical base extending laterally outward from said other side of said base and an enlarged cap at an outer end of said base.

10. A binding as claimed in claim 1, said locking member comprising an elongate bar, said second attachment means comprising a recess at a front end of said bar, said recess spaced from a bottom edge of the bar, and a slot extending from said bottom edge through said bar to said recess.

11. A binding as claimed in claim 10, said first attachment means comprising a plurality of pins extending laterally outward from an outer side surface of said bar, adjacent to a rear end of the bar and adjacent to a top edge of the bar.

12. A binding as claimed in claim 9, said locking member comprising an elongate bar including engagement means at front and rear ends of said bar, said engagement means at said front end comprising a semicylindrical recess in said front end, for engaging with said cylindrical base.

13. A binding as claimed in claim 12, including an arcuate recess around an outer periphery of said semicylindrical recess, for reception of said cap.

14. A binding as claimed in claim 4, including a first strap passing through said slot, said first strap having a plurality of rows of holes at the other end, each row of holes adapted to be selectively positioned over said projections.

15. In combination, a binding as claimed in claim 1, and a snowboard, said snowboard including attachment means for cooperation with the attachment means on said binder.

16. The combination as claimed in claim 15, said attachment means comprising a first arrangement adjacent to the center of the board and a second arrangement adjacent to the rear end of the board.

17. The combination as claimed in claim 16, said first arrangement comprising two sets of attachment means, a first set for attachment of the binding inclined at about 45° across the board in one transverse direction and the second set for attachment of the binding inclined at about 45° across the board in the other transverse direction, said second arrangement comprising attachment means for attaching the binding transversely of the board, approximately normal to the longitudinal axis of the board, in either transverse direction.

18. The combination as claimed in claim 15, said snowboard of elongate form, having a rounded front end, and rear end, said front end and said rear end curving upward in side view.

19. The combination as claimed in claim 18, said snowboard having a spherical bottom surface at the rear end, said spherical surface extending downward.

20. The combination as claimed in claim 18, including an upstanding rim extending peripherally of the snowboard.

* * * * *